United States Patent [19]

Moncrieff-Yeates

[11] 4,224,922

[45] Sep. 30, 1980

[54] ROOM AIR RECIRCULATING HEATER WITH UTILITY COMPARTMENTS AND DOORS STORABLE THEREWITHIN

[76] Inventor: Alexander J. Moncrieff-Yeates, 8924 Rhyme Ct., Annandale, Va. 22003

[21] Appl. No.: 847,586

[22] Filed: Nov. 1, 1977

Related U.S. Application Data

[63] Continuation-in-part of Ser. No. 570,798, Apr. 23, 1975, Pat. No. 4,056,091.

[51] Int. Cl.[3] ..... F24B 7/00; F24C 15/36

[52] U.S. Cl. ..... 126/121; 126/190; 126/202

[58] Field of Search ..... 126/121, 122, 123, 124, 126/126, 138, 139, 140, 190, 200, 202; D8/88; 16/125, 127, 110, 87, DIG. 11; 40/23 A; 308/3.6, 3.8; 292/347

[56] References Cited

U.S. PATENT DOCUMENTS

| | | | |
|---|---|---|---|
| 1,564,281 | 12/1925 | Setchfield | 126/202 |
| 1,604,457 | 10/1926 | Lowe | 308/3.8 |
| 1,778,943 | 10/1930 | Hoffman | 126/190 |
| 3,952,721 | 4/1976 | Patterson | 126/126 |
| 4,167,177 | 9/1979 | Wiggins | 126/121 |

FOREIGN PATENT DOCUMENTS

| | | | |
|---|---|---|---|
| 577717 | 5/1946 | United Kingdom | 126/202 |

*Primary Examiner*—Carroll B. Dority, Jr.
*Assistant Examiner*—Lee E. Barrett
*Attorney, Agent, or Firm*—Sixbey, Friedman & Leedom

[57] ABSTRACT

A heater including a fire enclosure, such as a fireplace, has side walls each of which includes spaced walls which define a passageway for circulation of room air and is provided with recesses adjacent to the fire enclosure and extending into the room air passageways. In a preferred embodiment, the fire enclosure doors are mounted in the compartments and are provided with a unique mounting and handle by which a particular door may be selected and moved to a closed position in front of the fire enclosure opening.

15 Claims, 9 Drawing Figures

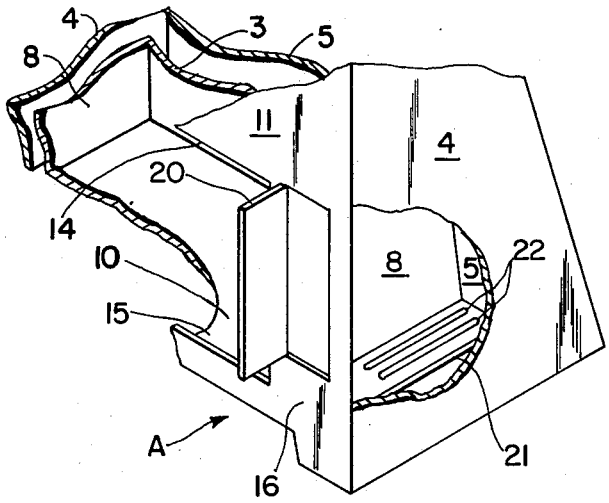
FIG. 1
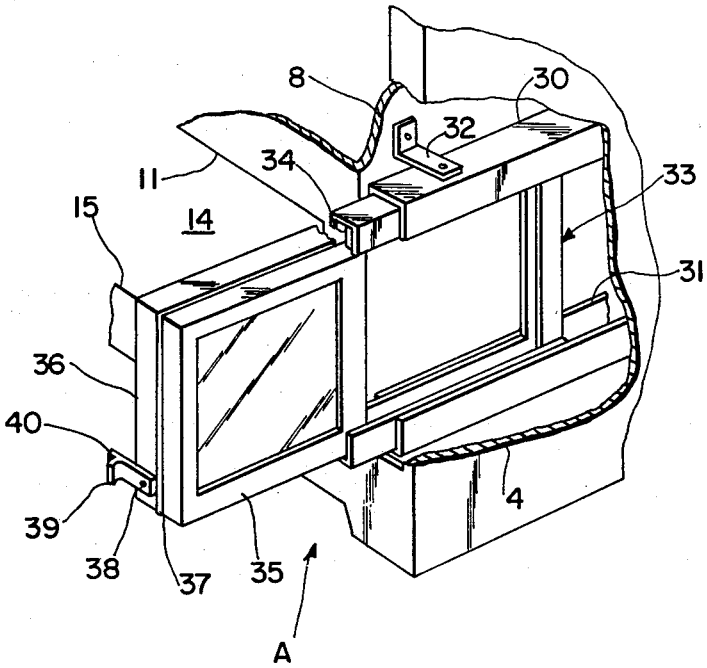
FIG. 2
FIG. 3
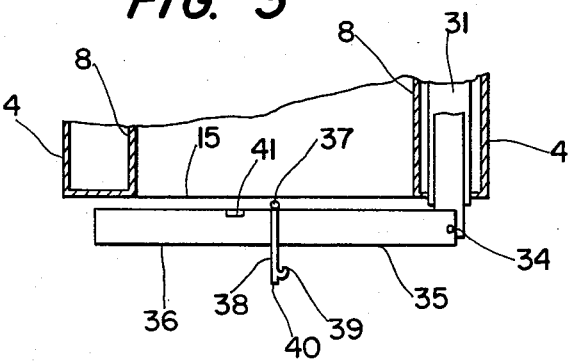
FIG. 4
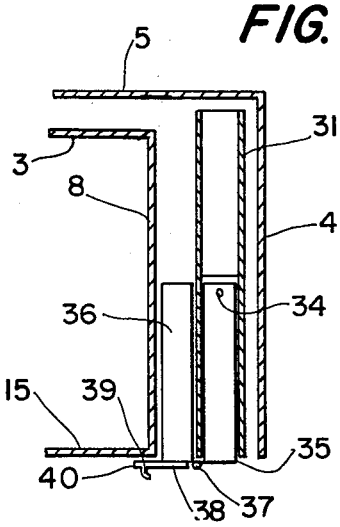

ROOM AIR RECIRCULATING HEATER WITH UTILITY COMPARTMENTS AND DOORS STORABLE THEREWITHIN

RELATED APPLICATION

This application is a continuation-in-part of my application Ser. No. 570,798 filed Apr. 23, 1975 (U.S. Pat. No. 4,056,091) entitled Vortical Flow Aerothermodynamic Fireplace Unit.

FIELD OF INVENTION

This invention pertains to a heating unit comprising a fire enclosure, such as a fireplace, space heater, central heater, stove, etc. The heating unit may be built in, or it may be of the free-standing insert type. In any event, the fire enclosure is bordered by side walls including provision for circulating room air.

BACKGROUND OF THE INVENTION

It has been known in the past to provide barriers for closing the access opening to a fireplace. These barriers have taken various forms, including wire screens, glass partitions, and solid fire resistant materials such as metal or asbestos sheets. Because of the rather wide expanse of the access opening to the fire enclosure, each barrier must be of substantial size, and hence becomes somewhat unwieldy when it must be removed during access or stored when not in use. Various expedients are known to cope with this problem. Units have been constructed which are completely portable and include an integral stand for placement on the hearth in front of the access opening, the units being free standing and independent of attachment to the fireplace itself. Design of such units incurs problems of compromising the need for avoiding excessive weight and bulk with the need for a stable structure.

The stability problem has encouraged the design of hinged or sliding units attached to the fireplace itself as seen in Goudy U.S. Pat. No. 3,372,689. However such units necessarily have occupied undesireably large amounts of space adjacent to the access opening when in the open position, and are considered by many to be unsightly in that they obscure the brick of the fireplace adjacent to the fire enclosure access opening when in open position.

In order to minimize the aforesaid unsightliness and space requirements, it has been proposed in Williamson U.S. Pat. No. 169,876 to provide a compartment on either side of the access opening, and to construct the door so as to be foldable so that it is sufficiently compact so as to fit within the confines of the compartment. The compartment of course, is necessarily of limited size because of the space available and the constraints of unsightliness mentioned above.

The prior art also includes fireplaces with compartments for other purposes, such as cooking or warming foods. As examplified by Wetzel U.S. Pat. No. 1,451,246 these compartments are of such size as to preclude their incorporation in normally constructed fireplaces, or, as in Marsh U.S. Pat. No. 413,350 are not accessible from the front of the fireplace, again precluding incorporation in a preexisting conventional fireplace design.

OBJECTS OF THE INVENTION

Against the aforementioned background of prior art, this invention provides a structure which has among its objects the following:

1. To provide a fireplace unit which includes compartments of general utility which are accessible from the front of the unit and occupy relatively little space along the front face of the fireplace,
2. To provide a fireplace unit which includes compartments of general utility which are accessible from the front of the unit and are of substantial depth,
3. To provide a fireplace unit in which room air circulates in passageways between spaced side walls and in which a compartment occupies a portion of said space in said passageways,
4. To provide a fireplace unit in which barrier doors are stored in a compartment which occupies a portion of a room air recirculating passageway adjacent to the fire enclosure,
5. To provide a fireplace unit which includes a plurality of different type barriers housed in a common compartment adjacent to the fire enclosure,
6. To provide a fireplace unit including doors housed in a compartment adjacent to the fire enclosure and hinged to a carrier slidably received in the compartment whereby the door and carrier may be extended from the compartment where the door may be pivotally moved to operative position, and
7. To provide a fireplace unit including a plurality of different type doors which include a unique handle arrangement by which they may be selectively operated.

DESCRIPTION OF DRAWINGS

The aforestated objectives, as well as other self-evident advantages and objectives, may be best understood by reference to the ensuing specification and drawings, in which:

FIG. 1 is a fragmentary perspective view, (partly broken away) of a fireplace including a utility compartment constructed in accordance with this invention, FIG. 2 is a fragmentary perspective view (partly broken away) of a fireplace illustrating one embodiment of a door housed within a compartment, FIG. 3 is a fragmentary plan sectional view of the embodiment of FIG. 2 illustrating the door in operative position, FIG. 4 is a fragmentary plan elevational view of the embodiment of FIG. 2 illustrating the door in housed position.

DESCRIPTION OF THE INVENTION

Figure 5:
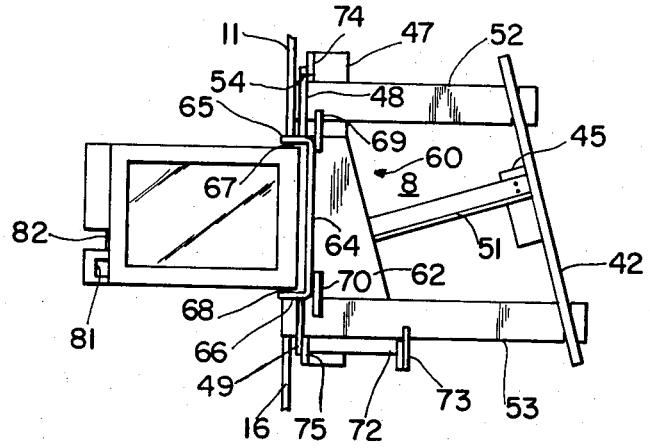
FIG. 5 is an elevational section of another embodiment of this invention illustrating the door in an intermediate position.
Figure 6:
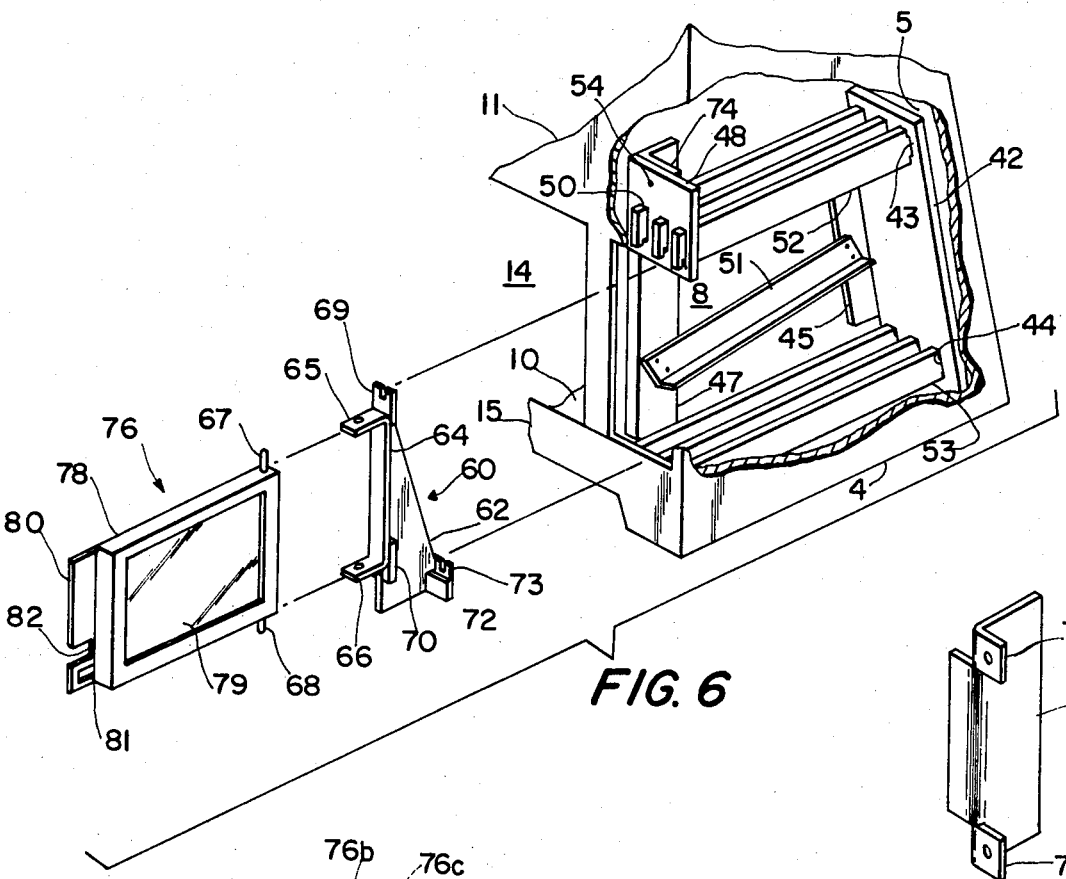
FIG. 6 is an exploded view illustrating the relationship of elements in the embodiment of FIG. 5.
Figure 6A:
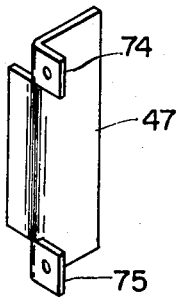
FIG. 6*a* is a perspective view of support member 47.

Referring first to FIG. 1, there is depicted a fragmentary view of a fireplace unit comprising an outer enclosure defined in part by outer side wall 4 and outer back wall 5. Spaced inwardly from the outer enclosure is a fire enclosure defined in part by inner side wall 8 and bottom or bed plate 10. Both enclosures share a common front face comprising an upper portion 11, a lower portion 15, and side portions 16 which define a fire enclosure access opening 14 therebetween. It is readily understandable that an alternative embodiment for insertion in a pre-existing fireplace structure to provide the confining function of the outer enclosure.

In either event, the spaced relationship of the fire enclosure walls from the outer enclosure defines passageways through which room air is circulated. Specifically, the lower portion 15 of the front wall includes provision in the form of an inlet opening through which room air is admitted to the passages in a manner indicated by the arrow A in FIG. 1. The air then follows several different paths including one subjacent to the bottom fire enclosure confines in the form of bed plate 10, one between the back wall 3 of the fire enclosure and the back wall 5 of the outer enclosure, and one between each fire enclosure side wall 8 and outer enclosure side wall 4. The heated air reenters the room through any suitable outlet (not shown).

Of the various passageways just defined, the passageway between the rear walls is the most effective from the standpoint of heat exchange, and it is desireable that the major portion of the flow be directed to that path. By the same token, the area available in the passageway between walls 4 and 8 is generally larger than appropriate. If unrestricted, room air tends to take the shortest path through the side passageways, thus short-circuiting the longer path under the bed plate 15 and up the back, with a consequent loss in heat exchange efficiency. Moreover, the air which does travel up the side passageways has just entered from the room and is characteristically relatively cool.

This invention takes advantage of the aforesaid characteristics and desiderata by advantageously utilizing the side passageway for storage of fireplace adjuncts, such as tools, cooking grills or utensils, or access opening covers such as screens, glass barriers, or quenching barriers.

To this end, a utility compartment opening is provided in the side portions 16 adjacent to the fire enclosure access opening 14. This opening communicates with the passageway defined by side walls 4 and 8, enabling one to place various items therein. In order to avoid disruption of the normal air flow, the compartment opening preferably includes a door 20 which is illustrated as being hinged to the portion 16 of the front wall, but could be structured as a sliding door or separable panel hung in place by any suitable means. It is within the concept of this invention that items placed within the compartment defined by the sidewalls and accessed through the opening be merely placed upon the fireplace hearth. The items placed therein constitute an insignificant impedance to total room air flow, but do present a slight impedance to room air flow in the side passageways, thus serving to encourage a large proportion of flow in the back passageway. However, in a preferred embodiment, the compartment includes a floor plate 21 disposed within the side passageway at a level at least as high as bed plate 10. This plate is designed to only partially obstruct air flow in said passageway, as by being of a limited extent or including apertures shown as slots 22 dimensioned to permit a controlled flow or room air upwardly through the floor plate 21 and around any articles placed thereon, thus increasing the total impedance to air flow and encouraging a larger percentage of flow in the back passageway. Should less impedence be desired, the floor plate could take the form of a stiff wire mesh, transverse bars, etc.

It should be observed that the relatively cool incoming room air flowing over any articles stored in the compartment maintain the articles at a sufficiently low temperature that they may be handled with bare hands. This is particularly beneficial when the items are fire tools, cooking utensils, grills, etc. which would ordinarily be handled at a time when the fireplace is in use. It is quite apparent that, without the room air circulation, items contained within a compartment located proximate to the sidewall would be heated to a point that handling would require insulative gloves, thus hindering one's use of the items.

Among the items which might be expected to occupy one or both of these compartments are barriers for placement in front of the fire access opening. Completely independent, unattached barriers may, of course, be stored in the utility compartment just described in conjunction with FIG. 1. However, a preferred structure includes means to support the item, such as a door in both a stored position within the compartment and in an operative position disposed across the fire enclosure access opening. One embodiment of such a structure is illustrated in FIG. 2–4, to which attention is now invited.

In this embodiment of the invention, a compartment is occupied by a single door of folded construction. It should be born in mind that the room air circulating passageway defined by an outer side wall 4 and a fire enclosure side wall 8 extends the entire depth of the fireplace unit, thus permitting an extremely deep compartment which utilizes this space. It is not unusual in fireplace design that this depth (i.e., the horizontal distance from front to rear of the passageway) is greater than one-half of the dimension of the width of the fire enclosure access opening. Hence, in this embodiment, it is possible to house within a single compartment a door unit comprising two panels 35, 36 which are hinged together. When the unit is moved to co-planar relationship in front of the access opening, it is sufficient to cover the entire opening, obviating the need for an additional unit on the other side of the access opening. Thus, a similarly situated compartment in the opposite room air passageway may be utilized for other purposes, such as storage of tools, cooking grills, etc.

Figure 8:
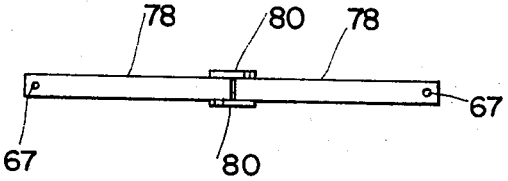
FIG. 8 is a diagrammatic plan view of a door in closed position.

The recess, whether provided in one or both sides of the fireplace, is partially defined by side walls 4 and 8. Disposed within at least one said recess is a track comprising an upper element 30 and a lower element 31 secured in place by any suitable means, such as brackets 32. Slidable in the track 30, 31 is a carrier generally indicated at 33 which carries a hinge pintle 34. Pivotally supported upon pintle 34 is a door here shown as a folding door comprising a pair of glass panels 35, 36 pivotally interconnected as a hinge pintle 37. A non-folding door can be provided, in which it would be appropriate to provide a track and carrier on each side of the fireplace to accommodate duplicate doors (see FIG. 8). In the preferred embodiment of a folding door, a convenient handle 38 is attached to the hingedly connected end of door 36 comprised a free end which is forked to provide a hooked finger tab 39 and a straight thumb tab 40. By virtue of its placement at a low position on the door and the cooling effect of the room air entering at arrow A, this handle remains cool to the touch. By engagement of the thumb and forefinger with the tabs 40 and 39, respectively, the door may readily be pulled from its retracted position shown in FIG. 4 to be extended position of FIG. 3, this rectilinear motion being accommodated by the sliding of the carrier 33 in the track elements 30, 31. At that point, a rotary motion by the thumb and finger pivots door 35 with respect to door 35 and permits bringing the door to the closed position illustrated in FIG. 3, at which a permanent magnet 41 retains the door in position against the front lower portion 15.

A preferred embodiment of fire enclosure barriers housed within the room air recirculating passageway is illustrated in FIGS. 5–8, initial attention being now invited to FIG. 5.

This embodiment provides a plurality of diverse doors in a single fireplace unit. For instance, one door may be a screen, another glass, and the third a fire resistant barrier such as metal. The latter would find use in allowing a fire to extinguish after use and hence is termed a quencher door. To the end that a pack of doors may be housed in the relatively narrow confines typical of a room air recirculating passage, a trackway assembly is provided in which each track does not exceed the thickness of a single door panel and in which adjacent trackways are disposed extremely close to one another, while permitting air flow upwardly through the assembly. A novel handle configuration facilitates selection and withdrawal of a particular door in accordance with the desire of the user.

Specifically, the trackway assembly comprises a rear track support 42 disposed at an angle substantially parallel to the back wall 5 of the unit. Rear track support 42 includes a row of upper slots 43 and a row of lower slots 44 for reception, respectively, of upper and lower track elements. The track support includes a mounting flange 45 extending forwardly along at least a portion of one edge. Spaced forwardly of said rear track mount 42 is a front track support assembly comprising a vertical support member 47 to which are attached upper track mounting element 48 and lower track mounting element 49. Elements 48 and 49 respectively include groups of slots, evident as slots 50 in element 48, these slots being dimensioned to receive the forward ends of the track elements. Because of the cooling effect of the room air flow, elements 48 and 49 may be formed of plastic. The rear track support 42 and front track assembly are tied together by a brace element 51 in the form of an angle iron interconnecting the flange 45 and the support member 47 and welded in place.

Each of the three parallel tracks comprises an upper rail 52 and a lower rail 53. Both sets of rails are notched in both top and bottom edges near the rear ends thereof and notched in the bottom edge near their front ends. In assembly, the each rail is thrust through the corresponding slots 43, 44 of the rear track support 42 in a direction normal thereto, after which they are moved to final position where the support 42 is canted in respect to the rails 52, 53, thereby bringing the edges of slots 43, 44 into registry in the notches at the rear ends of the rails. Track mounting elements 48 and 49 are then canted and brought into position where the lower edge of each slot is in registry with the notch on the bottom of each rail. Each mounting element is then swung to a vertical position to bring the top edge of each slot 50 over the top edge of the corresponding rail 52 or 53 and is attached to support member 47 either by welding or by an appropriate fastener at the position indicated at 54.

Each track thus comprises spaced parallel vertically co-planar rails 52 and 53, between which is supported a carrier generally indicated at 60. The carrier comprises a generally planar, triangular hanger 62 having a flange 64 extending over the major portion of the vertical forward edge and terminating at each end in forwardly extending door support tabs 65 and 66, each of which includes an aperture for receiving pintles 67 and 68, respectively. Attached to each end of the flange 64 and extending in coplanar relationship to the flange beyond the support members are front glides 69 and 70. Each glide is shown notched at the center of its outer edge, the notch being dimensioned to provide a clearance fit over the rails 52 and 53. The hanger 62 extends below the lower lower glide 70 a distance sufficient to bring the lower edge below the bottom edge of bottom rail 53 and includes a tab 72 to which is attached a rear glide 73 extending upwardly and notched at its uppermost edge to receive the bottom edge of rail 53. The glides 59, 70 and 73 are formed of heat resistant low friction plastic which slides readily on rails 52 and 53, but it should be understood that anti-friction elements such as wheels or rollers may be incorporated at the base of the slots or in lieu of the glides for additional ease in operation.

In assembly, the door 76 is first assembled to a carrier by passing pintles 67, 68 through the apertures of respective support tabs 65, 66 which are sufficiently resilient to permit spreading during assembly. The door is then swung to position substantially perpendicular to the plane of the hanger 60, which may be tilted with its upper end backward, at which position the glide 73 may be engaged with the underside of rail 53, and the glides 69, 70 brought into alignment with the lower edge of rail 52 and the upper edge of rail 53. Finally, the carrier 60 is returned to its upright position to engage glides 69, 70 with the respective rails and thus accomplish a cantelever suspension, the load being assumed by glides 70 and 73 and glide 69 serving to maintain the carrier 60 in the plane of rails 52 and 53.

Figure 7:
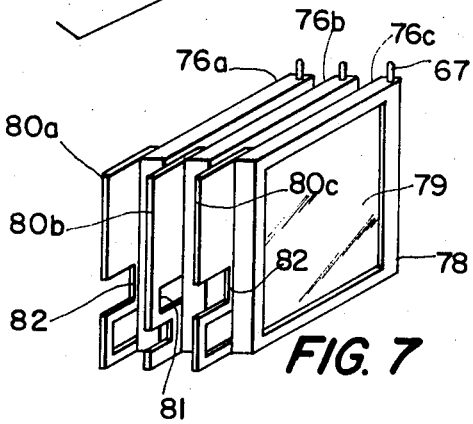
FIG. 7 is a perspective view of the doors of FIGS. 5 and 6 illustrating the handle relationship.

Supported from the support tabs 65 and 66 is a door unit 76 which may take any desired form, but generally, includes a frame 78 in which may be disposed a glass 79, a screen (not shown) or a solid heat resistant barrier such as asbestos sheet or metal sheet (not shown). In its preferred form, this invention provides an assembly of three doors at each side of the fireplace unit, as illustrated in FIG. 7. Because of the closely packed side-by-side arrangement of doors **76*a*, 76*b*, and 76*c* and their location within the confines of the relatively narrow recess, it would become difficult to select a particular door and engage a handle thereon if each handle were identical. Then again, from the standpoint of ease of manufacture and expense of tooling, it is undesireable to adopt a design which requires a differently oriented handle for each door. This invention enables the use of a single handle design which is incorporated in the basic door structure in a manner to provide selectively accessible handles. To this end, each door frame 78 is provided at its free (unhinged) end with a lip 80. As evident in FIG. 8, each lip 80 of the doors 76 on one side of the fireplace are attached to the inner side of the door, whereas each lip 80 of the doors 76 on the other side are attached to the outer side. When in the closed position, the lips 80 each overlap the frame 78** of the cooperating door to provide a double seal against sparks or unwanted air intake as the case may be.

Each lip 80 is formed at least in part in serpentine pattern. Thus, when attached to the frame 78, this pattern results in a series of at least two vertically adjacent loops, one of which is a closed loop 81 and the other of which is an open loop 82. By merely reversing the lip prior to attachment, the position of the open and closed loops is reversed. Referring again to FIG. 7, a pack of three doors is shown in the relationship which they assume in stored position within the recess. Noting that the central door 76*b* has its lip 80*b* reversed in relationship to the lips 80*a* and 80*c*, it is seen that each closed loop 81 is adjacent to an open loop 82. Thus, a finger or tool such as a poker can be readily engaged with the closed loop 81 because the adjacent open loop 82 provides sufficient clearance for this purpose.

In operation from a retracted or stored position within the compartment, the desired door is selected by engagement of the closed loop handle 81 and withdrawal of the door 76 from the compartment. This, of course, is accomplished by movement of the carrier 60 forwardly along its trackway from the rear or retracted position to a forward position at which the door 67 is extended forwardly of the fireplace front wall 11, 16. Further forward movement is prevented by engagement of the glides 69, 70 with mounting elements 48, 49 extending from inwardly projecting wings 74, 75 of support member 47. At this point, the cantelever suspension places the pivot point of the door as defined by pintles 67, 68 outwardly of the fireplace front wall 11, 16. Hence, the door may now be moved from its extended position by swinging it on its pivots 67, 68 for positioning in a closed disposition in front of the access opening of the fire enclosure.

The foregoing description has set forth in detail three embodiments of the invention, the preferred embodiment being that of FIGS. 5 through 8. This detailed description has been rendered for the purpose of satisfying the disclosure requirements of 35 USC 112 and is not to be regarded as limiting the invention to the details set forth. The scope of the invention should be construed in accordance with the following claims.

I claim:

1. In a heating unit of the type including a front face, a fire enclosure accessed through said front face and defined in part by inner side walls and wherein outer side walls are spaced outwardly from said inner walls, the space between said side walls defining a passageway which constitutes a portion of a room air recirculating path, the improvement wherein said front face includes an opening therein communicating with said passageway, whereby items may be stored within said passageway and wherein the improvement further includes at least one door positionable in a closed disposition in front of the access opening to said fire enclosure, carrier means pivotally supporting said door for swinging motion between said closed position to an extended position coplanar with the passageway defined by said spaced side walls and aligned with said opening, and means mounting said carrier for rectilinear movement within said passageway between a forward position supporting said door in said closed or extended positions and a retracted position in which said door is stored within said passageway, said door includes a lip extending outwardly from the free unhinged end of said door in substantially aligned relationship with said door, said lip having at least a portion thereof formed in a serpentine pattern to provide at least one open loop and at least one closed loop, the closed loop being usable as a handle for said door.

2. A heating unit as set forth in claim 1 including a plurality of said doors disposed in side-by-side relationship when in stored position within said passageway, said serpentine pattern being reversed between adjacent doors whereby the closed loop of each lip is disposed adjacent to an open loop of the adjacent door, said open loop providing a clearance space to facilitate engagement of the adjacent closed loop.

3. A heating unit as set forth in claim 1 wherein at least one said door is disposed at each side of the access opening to said fireplace, said lip of one door being disposed in substantial alignment with the plane of the side of said one door proximate to said access opening and said lip of the other door being disposed in substantial alignment with the plane of the side of said other door remote from said access opening, said door being dimensioned to cause each of said lips to overlap the corresponding surface of the other door when in closed position.

4. Apparatus for heating room air by recirculating room air in heat exchange relationship with a fire, comprising (a) a hollow outer enclosure including
  (1) a front wall containing a central opening,
  (2) a pair of outer side walls connected with said front wall, and
  (3) an outer back wall;

(b) a fire enclosure means mounted within said hollow outer enclosure for containing a fire accessible through said central opening and for forming, in part, a room air recirculating path designed to maintain recirculating air separate from the combustion products produced by a fire contained within the fire enclosure means, said fire enclosure means including:
  (1) a pair of inner side walls spaced inwardly of said outer side walls to form a pair of side passageways in which air passes generally upwardly within the room air recirculating path, each said side passageway, when unrestricted, having an extent in excess of that required for obtaining maximum heat exchange efficiency between the recirculating room air and the fire contained within said fire enclosure means,
  (2) an inner back wall spaced inwardly of said outer back wall to form a back flow path making up a portion of the room air recirculating path, said back flow path having an extent which is insufficient to obtain maximum heat exchange efficiency between the room air and the fire when said side passageways are unobstructed, and
  (3) a bed plate; and (c) storage compartment means formed within said room air recirculating path for storing items useful in operating a fire containing heating apparatus, said storage compartment means including
  (1) access means contained in said front wall for permitting the items to be inserted and removed from at least one of said side passageways, said access means including an access opening contained in said front wall and closure means for selectively closing said access opening, and
  (2) item support means within the side passageway accessible through said access means for supporting items which are inserted into the passageway in a manner to allow for direct contact with room air passing generally upwardly through said passageway and for partially obstructing the accessible side passageway to increase the heat exchange efficiency of said heating apparatus by diverting some of the recirculating air from the partially obstructed side passageway into the back flow path, said item support means including a floor disposed within said accessible side passageways at a level above said bed plate, said floor containing openings to allow the flow of room air therethrough.

5. Apparatus as defined in claim 4, wherein said access opening contained in said front wall is spaced laterally from said central opening.

6. Apparatus as defined in claim 5, wherein said access means includes a second access opening contained in said front wall spaced laterally of said central opening on the opposite side of said first access opening and a second closure means for said second access opening.

7. Apparatus as defined in claim 4, further including at least one door positionable in a closed disposition in front of said central opening to said fire enclosure means, said floor including carrier means pivotally supporting said door for swinging motion between said closed position to an extended position coplanar with said accessible passageway and aligned with said access opening, and means mounting said carrier for rectilinear movement within said accessible side passageway between a forward position supporting said door in said closed or extended positions and a retracted position in which said door is stored within said accessible side passageway.

8. Apparatus as defined in claim 7, including at least one said door, at least one said carrier, and at least one said mounting means disposed at each side of the central opening to said fire enclosure means.

9. Apparatus as defined in claim 7, wherein said door comprises an assembly of two panels hinged together for disposition in coplanar aligned relationship in front of said central opening, and for disposition in hinged side-by-side relationship when disposed in stored position in said accessible side passageway.

10. Apparatus as defined in claim 9, including a handle element rigidly secured to the hinged edge of the outermost of said panels whereby said handle may be used for movement of said door assembly between said aligned relationship and said side by side relationship.

11. Apparatus as defined in claim 7, wherein said means mounting said carrier means comprises a track including an upper rail and a lower rail disposed in spaced parallel vertically coplanar alignment, and said carrier means includes a generally planar hanger, said hanger including an upper glide member having a surface registerable with said upper rail and lower glide members having surfaces registerable with said lower rail.

12. Apparatus as defined in claim 11, wherein said lower glide members comprise spaced front and rear members, said front glide member disposed in registration with the upper surface of said lower rail and said rear glide member disposed in registration with the lower surface of said lower rail.

13. Apparatus as defined in claim 12, wherein said hanger is generally triangular including a vertical forward edge, said upper glide member and said forward lower glide member being disposed near said forward edge, and said pivotal door supporting means is disposed at said forward edge.

14. Apparatus as defined in claim 11, wherein said glide members include anti-friction elements registerable with said rails.

15. Apparatus as defined in claim 4, including carrier means for at least one item disposed within said accessible side passageway and mounting said carrier means for rectilinear movement between a position projecting said item forwardly of said front wall and a retracted position in which said item is stored within said accessible side passageway.

* * * * *